US005094453A

United States Patent [19]

Douglas et al.

[11] Patent Number: 5,094,453

[45] Date of Patent: Mar. 10, 1992

[54] BALL BAT WITH INWARD OFF-SET CENTER OF GRAVITY

[76] Inventors: Preston L. Douglas, 3460 Red Cloud Trail, St. Augustine, Fla. 32086; William J. Prosser, 706 S.W. 81st Ave., North Lauderdale, Fla. 33068

[21] Appl. No.: 559,158

[22] Filed: Jul. 25, 1990

[51] Int. Cl.[5] ..... A63B 59/06

[52] U.S. Cl. ..... 273/72 A; 273/72 R; 273/73 J

[58] Field of Search ..... 273/72 A, 72 R, 26, 273/235

[56] References Cited

U.S. PATENT DOCUMENTS

| | | | |
|---|---|---|---|
| 59,313 | 10/1966 | Hill . | |
| 364,160 | 5/1987 | Cundey . | |
| 377,686 | 2/1988 | Moose . | |
| 727,359 | 5/1903 | Held . | |
| 796,184 | 8/1905 | Brown | 273/72 R |
| 814,857 | 3/1906 | Maechling . | |
| 1,026,990 | 5/1912 | Matson | 273/72 R |
| 1,121,189 | 12/1914 | Lincoln . | |
| 1,499,128 | 6/1924 | Shroyer, Jr. . | |
| 2,121,289 | 6/1938 | Gleadall | 273/73 |
| 2,195,681 | 4/1940 | Robarge | 273/72 |
| 2,944,820 | 7/1960 | Paullus | 273/72 |
| 2,984,486 | 5/1961 | Jones | 273/72 |
| 3,377,066 | 4/1968 | Trowbridge | 273/72 |
| 3,861,682 | 1/1975 | Fujii | 273/72 A |
| 3,963,239 | 6/1976 | Fuji | 273/72 A |
| 3,972,528 | 8/1976 | McCracken | 273/72 A |
| 4,016,640 | 4/1977 | Briggs | 273/72 |
| 4,298,425 | 2/1981 | Easton et al. | 273/72 A |
| 4,347,280 | 8/1982 | Lau et al. | 428/304.4 |
| 4,714,251 | 12/1987 | Cook | 273/72 |
| 4,834,370 | 5/1989 | Noble et al. | 273/72 A |
| 4,844,460 | 4/1989 | Mitchell et al. | 273/72 |
| 4,940,247 | 7/1990 | Magadmi | 273/72 A |

FOREIGN PATENT DOCUMENTS

| | | | |
|---|---|---|---|
| 22649 | 7/1948 | Finland | 273/72 R |
| 23495 | 9/1949 | Finland | 273/72 R |

*Primary Examiner*—Edward M. Coven
*Assistant Examiner*—Mark J. Graham
*Attorney, Agent, or Firm*—Oltman and Flynn

[57] ABSTRACT

A ball bat having a bat handle, a handle end of the bat, a bat head, a center of gravity and weights on the bat handle end for offsetting the center of gravity in the direction of the handle end. The bat also may have grooves in the bat wall to lighten the bat head, and an inward projecting acorn-shaped weight at the handle end.

12 Claims, 3 Drawing Sheets

BALL BAT WITH INWARD OFF-SET CENTER OF GRAVITY

The invention relates to an improved bat, and more particularly to a ball bat with an inward off-set center of gravity.

BACKGROUND AND PRIOR ART

Ball bats of known construction have a shape such that the center of gravity of the bat falls approximately one third of the length of the bat from the head end of the bat. The conventional construction of the bat leads to the drawback that the hitter has a diminished feel and control of the bat, with a resulting diminished precision in hitting the ball. In order to overcome this problem hitters have applied pine tar to the handle to achieve a better grip friction and a better kinaesthetic awareness which is a prerequisite for attaining good rhythm, timing, quickness, power, control and efficiency.

Traditional bats have always exhibited destructive effects on hitters, since they are too long and too heavy, with the majority of weight in the bat head. The center of gravity is more toward the head end of the bat which makes the bat top heavy and causes poor bat head control. The bat head is hard to start, virtually impossible to control through the preparatory swing and follow through phase, and it is even harder to stop the forward momentum of the bat head, if at the last fraction of a second the batter decides that the does not want to offer at the thrown ball.

A head-heavy bat creates leverage problems, disrupting the stability of the body when the bat head-heavy weight creates a counter force that acts upon the body to jerk the batter in many different directions and away from a controlled, efficient movement pattern. The head-heavy bat misaligns the skeletal system with the poorly positioned bat mass, causes a large portion of muscle fibers to contract just to neutralize the negative forces applied at the bat head, which reduces the availability of the muscles for a fast limb movement such as hitting an object with a striking implement. It is generally accepted that muscle fibers operate on an all-or-nothing principles, they either contract completely or do not contract at all. This exterior weight placement causes a considerable portion of the estimated 250 million muscle fibers of the body to be placed in a state of contractability just to neutralize the counter forces of the head-heavy bat.

The muscular-skeletal disruption caused by the more distally placed center of gravity of the conventional bat requires a great degree of internal muscular application to keep the skeletal system stable during the movement phase. The all-or-nothing law of contractability of muscle fibers further hampers the potential for an explosive movement pattern by preventing the nerves and muscles from working together effectively. The muscles are already contracted as a direct result of the head-heavy bat and therefore cannot be acted upon or triggered by the nerves, which determines the firing quickness and the number of muscle fibers activated for the specific force to be applied. The neruomuscular application of force transferred from the body to the bat during the swing phase is directly responsible for speed, precision and power.

The conventional bat construction creates negative leverage, disrupts the delicate inner balance mechanisms of the body, reduces the efficiency of the muscles and neutralizes the responsiveness, or triggering effect of the nerves to fire the muscles.

Due to the lightness of the conventional bat handle, with resulting distant center of gravity of the bat disposed as much as approximately three-fourths of the bat length (about 27 inches) of a regulation bat from the handle end, i.e., the bat knob, the forces acting on the body and the limbs of the hitter make it much more difficult to control the movement of the bat head, and cause additional stress to hitters' joints and connective tissue, which in worst cases can disrupt a joint, and cause injuries to the arms and body.

It is accordingly a primary object of the invention to provide a ball bat with features sufficient to overcome the drawbacks of the known ball bats and to provide a precision striking implement capable of producing better hitting proficiency with reduced strains to the body of the hitter.

SUMMARY OF THE INVENTION

According to the invention, there is provided a tubular striking implement that provides all of the above mentioned benefits or improvements over existing bats by causing an overload-underload stabilization and development of the inner functions of the body since there is better balance between the bat and the body. There is a positive leverage application that is constructive instead of destructive. There is less possibility of the muscular-skeletal system being disrupted or negatively acted upon. The neuro-muscular system will be allowed to function at maximum efficiency thus avoiding the usual tug-of-war battle with the premature contractions of the muscles to keep the body in equilibrium, and there is greater potential for speed, precision and power because of the elimination of stress elements placed upon the body by the head-heavy bat.

In a striking situation, the more nearly the force applied to the object being struck is in line with its center of gravity, the greater the force transferred to the object (ball) in the desired direction. Understanding this law of physics further brings into proper perspective our concept of bringing the center of gravity closer to the hands and body, which allows for a more consistent and less stressful application of forces to the ball. This center of gravity change and bat head control afforded to the batter provides the batter with the physical capabilities to strengthen an area of weakness that most hitters exhibit, which is their inability to get the bat head "sweet spot" or center of percussion to the ball. The quickness and bat head angle required to impact the ball successfully over the entire strike zone simply has not been seen with any degree of consistency throughout the years. The bat head has traditionally been too heavy with the center of gravity too far away from the body to permit the precision-like quickness necessary for consistent, solid contact. Consequently, the pitchers that have been taught to pitch inside to the batters, and those that have the courage to do so, become highly successful at all levels of play. This pitching philosophy evolved simply because the current implement (bat) is not designed for total plate coverage efficiency.

In accordance with the invention there is provided a ball bat having a bat handle, a handle end of the bat, a bat head, a center of gravity and an inward extended weight attached to the bat handle for off-setting the center of gravity in the direction of the handle end.

In accordance with another feature, weight is removed from the bat head by forming circular grooves in the wall of the bat head, wherein the grooves are arranged substantially coaxially with the axis of the bat.

In accordance with a further feature there is provided a ball bat which includes an acorn-shaped knob attached to the handle for containing the weight.

In accordance with still another feature, the ball bat according to the invention includes a metal core inserted into a cylindrical part of the acorn-shaped knob on the bat handle, wherein the metal core includes lead, and/or alloying metals such as tin, aluminum, zinc and the like.

In the ball bat according to the invention the cylindrical part of the acorn-shaped knob is placed coaxially with the body of the bat and the weight may have a given weight selected such that the center of gravity of the bat is located substantially a distance less than three fourths of the length of the bat from the handle end, or even further inward from the knob end toward the hitter.

The ball bat according to the invention may have a friction lining on the bat handle.

The shifting of the center of gravity toward the body of the hitter causes a beneficial "underloaded" kinaesthetic feel of the bat, and a more easily noticeable feeling of lightness to the user, which enables the user to more comfortably handle a much greater total weight than is possible in the conventional bat.

It follows that the invention can be applied to bats made of different materials such as wood, aluminum and others, and they can have thinner wall thicknesses of the bat head to make it lighter by as much as 80% compared with the known bats. The use of the lighter bat according to the invention will cause improved muscular and neuro-muscular development of the player to maximize the best possible muscle-memory swing pattern.

The use of the ball bat according to the invention with its overload-underload construction concept will provide a ball bat with biomechanical capabilities to dramatically reduce the user's swing (reaction) time (the time the batter needs to carry his bat forward to impact the ball) which correspondingly will dramatically increase the decision-making time (the time that the user has to evaluate the incoming object (ball). The reduced swing (reaction) time and the increased decision time will permit the hitter to better utilize his visual faculties to track the ball longer, thus obtaining more information about ball velocity, rotation (spin), angle of trajectory, etc., to allow for a more through evaluation of the pitch which will reduce the probability of making a wrong decision.

It follows that the inventive concept may be applied to other hitting implements, such as tennis racquets, golf clubs, etc., and possibly hammers, axes and the like.

Most aluminum bats, due to the manufacturing process have an elliptical cross-section. The bat according to the instant invention will preferably be constructed, but not limited to, a circular cross-section along the entire bat, which will improve the bat/ball contact.

The weight near the handle acts as a shock absorber to reduce the compressive shock forces that enter the body (joints and connective tissue) every time contact with the ball has been achieved. These forces are transferred inward to the added weight in the handle to be absorbed by the implement and not the body. This added weight greatly reduces the vibratory forces from the impact and acts as a stress reduction buffer between the bat and the body. The traditional bat forces are spread out over the whole bat, or shell, to be dispersed at its only outlet—the body. Fifty to seventy five percent of all arm injuries occur as a result of improper batting techniques and not from the actual throwing. Increased training devices and drills have allowed hitters to do much more work in less time. The forces from hundreds or thousands of swings disrupt the integrity of the joints and connective tissues, which sets the stage for injury.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangements shown since the invention is capable of other embodiments. Also the terminology used herein is for the purpose of description and not of limitation.

DESCRIPTION OF THE PREFERRED EMBODIMENTS

Figure 1:
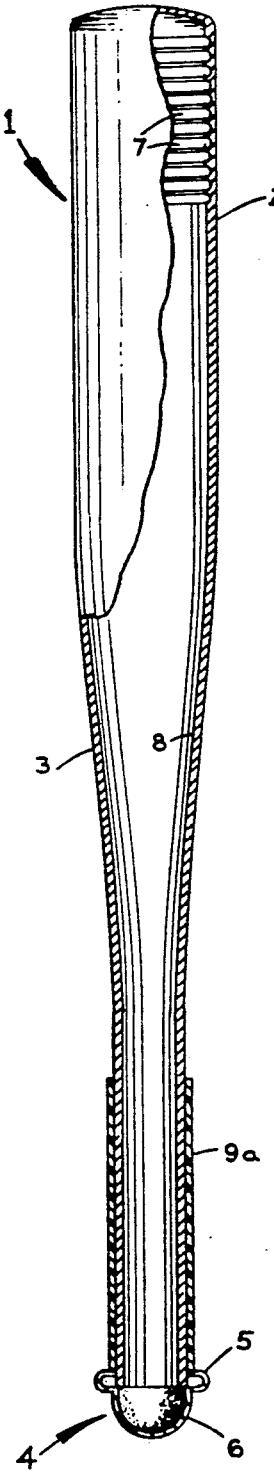
FIG. 1 is an elevational, part cross-section of the invention showing its interior construction.
Figure 2:
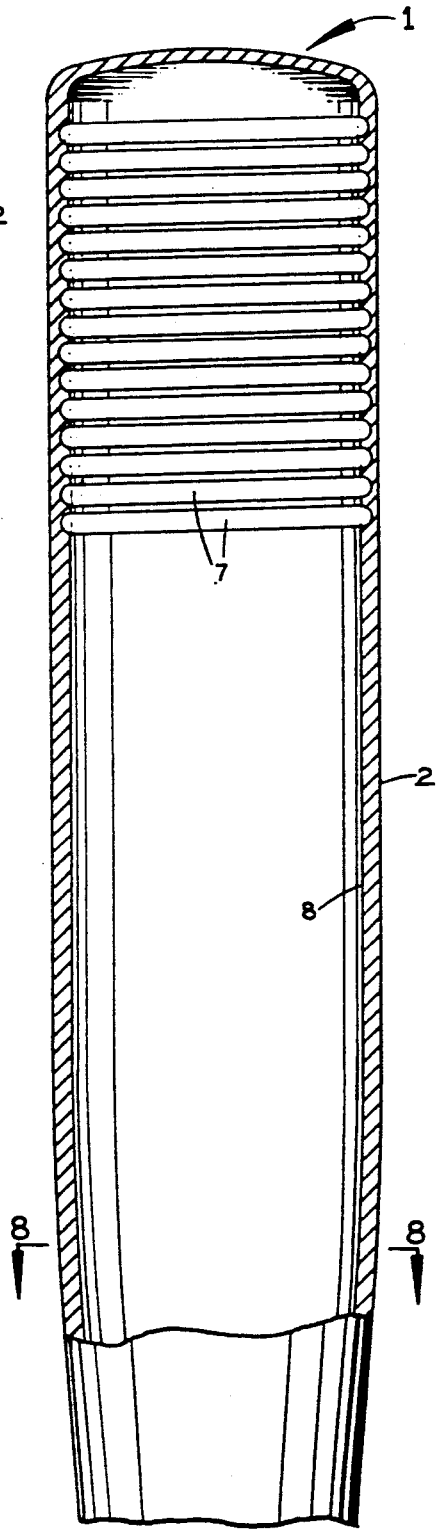
FIG. 2 is a fragmentary cross-section of the invention showing the bat head interior construction.

In FIGS. 1 and 2, a ball bat according to the invention has an elongate hollow tubular body 1 with a head end 2, a tapered handle end 3 formed of walls 8 made preferably of aluminum alloy with a thickness sufficient to drive a ball with an impact pressure of approximately 200–400 pounds per square inch to a speed equal to or greater than the speed of the impacted object (ball). The bat is terminated at the handle end in an acorn-shaped knob 4, shown in more detail in FIGS. 7 and 11. Internal grooves 7 in planes perpendicular to the tubular body are formed in the inner surface of the bat walls 8 in order to remove weight from the head end of the bat, while still retaining sufficient wall strength integrity to drive a ball.

Figure 7:
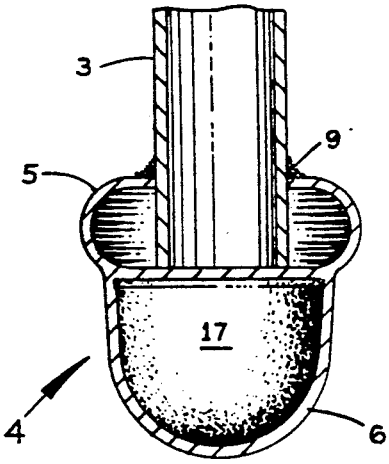
FIG. 7 is a section of the bat handle part according to FIG. 6 in final form.
Figure 11:
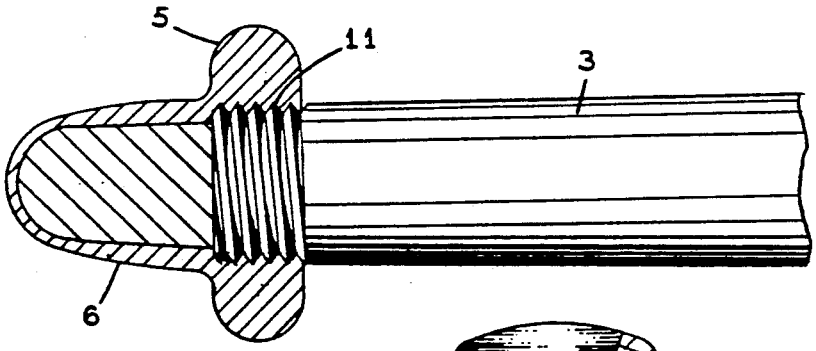
FIG. 11 is a section of the bat handle showing weighted parts of an acorn-shaped knob attached to the bat handle.

The tapered handle end 3, terminated in the acorn shaped knob 4, is shown in more detail in FIGS. 7 and 11. The acorn-shaped knob has a hollow extension 6 that objects or extends away from the bat handle toward the body of the batter, and a hollow or solid circular disc section 5 formed or solid (FIG. 11) so that it is readily attachable to the end of the bat handle 3, for example by means of a weld seam 9 or screw threads 11. The hollow extension 6 is filled with heavy metal, e.g. lead, so as to bring the center of gravity of the bat inward toward the player. The lightening of the bat head 2 and the additional weight in the extension 6 combine to move the center of gravity inward.

Figure 10:
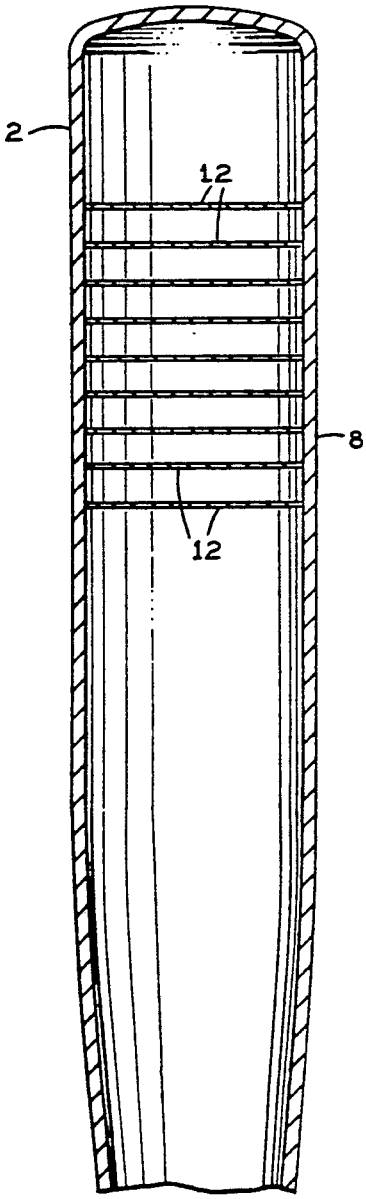
FIG. 10 is a section of the bat head with internal reinforcement of foam and/or thin light-weight discs of aluminum, etc.

In order to allow the walls 8 to be as thin and light as possible, and still have adequate strength to drive the ball, reinforcing material 12 of light weight foam, e.g. styrofoam, structural foam or the like, may be inserted in the head end as shown in FIG. 10, advantageously in the form of discs tightly fitting inside the head end.

With the bat loaded with weights in the acorn-shaped extension 4 as described above, and with the head end lightened as described, it is attainable to move the center of gravity toward the handle end such that the center of gravity may fall somewhere between 25%-75% of the length of the striking implement from the knob end, which substantially improves the control and precision of the invention over bats of known construction.

It follows that the improvement of the bat in moving the center of gravity inward, can also be applied to other sports implements such as, for example, a tennis racquet 12, or a fishing rod for casting (not shown), by adding the acorn-shaped weighted extension 4 to the inward end of such implements.

As a further improvement, a friction lining 9 of soft plastic material, as seen on FIG. 1, may be applied to the handle end of the bat or implement to provide a better grip and to cushion the user against vibrations from contact between the bat and the ball. The friction lining can be weighted.

Figure 5:
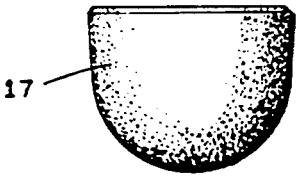
FIG. 5 is an elevation of a weight preformed (molded or tooled) to be inserted into FIG. 6 before roll form. cap.
Figure 6:
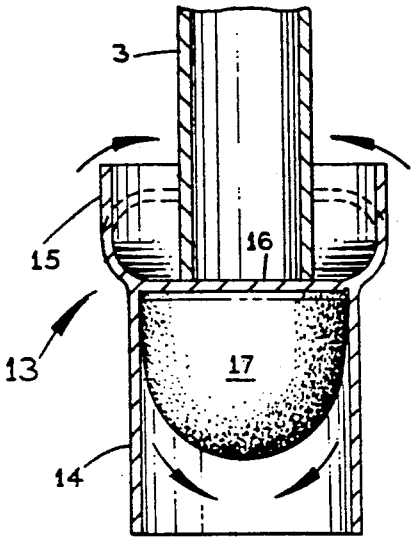
FIG. 6 is a section of another bat handle part, showing roll forming of the part.
Figure 9:
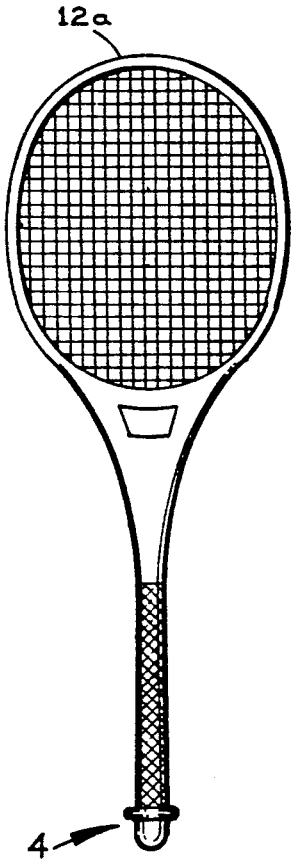
FIG. 9 is a plan view of a hitting implement in the form of a tennis racquet.

The method of forming the acorn-shaped knob 4 is shown in FIG. 6, wherein an interim component 13 is composed of two open-ended tube sections 14 and 15 joined by common wall 16, and wherein the open ends are roll-formed toward the center, as indicated by dashed lines. FIG. 5 shows a lead insert 17 that goes inside tube section 14 before it is roll-formed.

Figure 8:
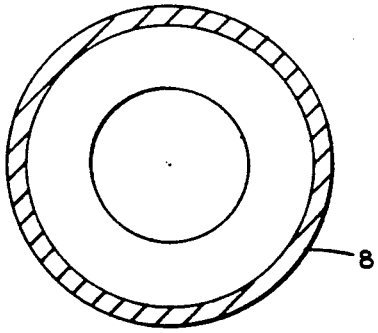
FIG. 8 is a transverse section of the bat seen along the line 8—8 of FIG. 2.

FIG. 8 shows a cross-section through the bat seen along the line 8—8 of FIG. 2.

Figure 3:
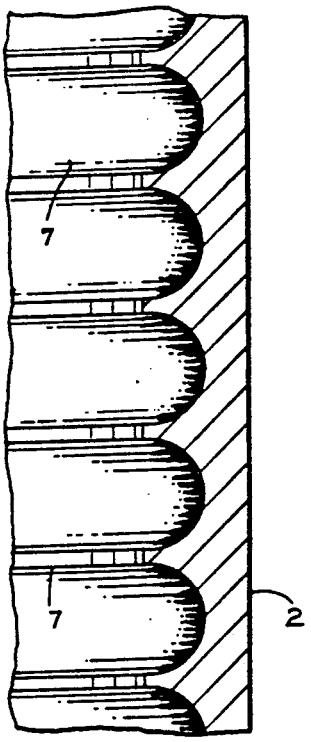
FIG. 3 is a fragmentary, enlarged detail view of the invention showing a section of the bat head wall.

FIG. 3 shows a fragment of the tube wall of the head end 2 with the grooves 7 formed therein. The grooves have rounded bottoms for maximum strength.

Figure 4:
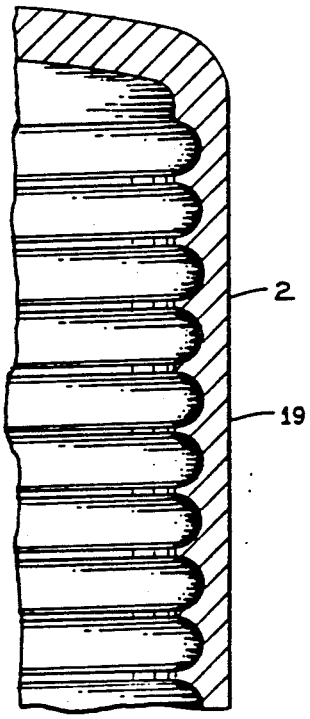
FIG. 4 is a fragmentary detail view of the invention showing an upper section of the bat head wall.

FIG. 4 shows an enlarged fragment of the upper part of the wall 2, wherein the grooved section has been extended downward to encompass the area 19 where the ball impacts the bat.

FIG. 2 shows a single start groove, helical in design and progressing toward the inward part of the bat (like a screw thread). It follows that this basic helical design can be a multiple start groove or grooves, producing a more inclined lay of each groove and therefore enhancing the overall construction, for the purpose of resisting the destructive tendency of impact. Also, the grooves can be non-helical and individual, single, separate and incrementally placed at 90° to bat axis.

FIG. 11 shows a solidly machined cap on the acorn configuration with a hollow section for inclusion of a pre-cast acorn shaped billet, or a cavity section made accessible for the pouring of molten lead. The knob can be provided with internal threads for attachment to external threads on the bat handle.

Figure 12:
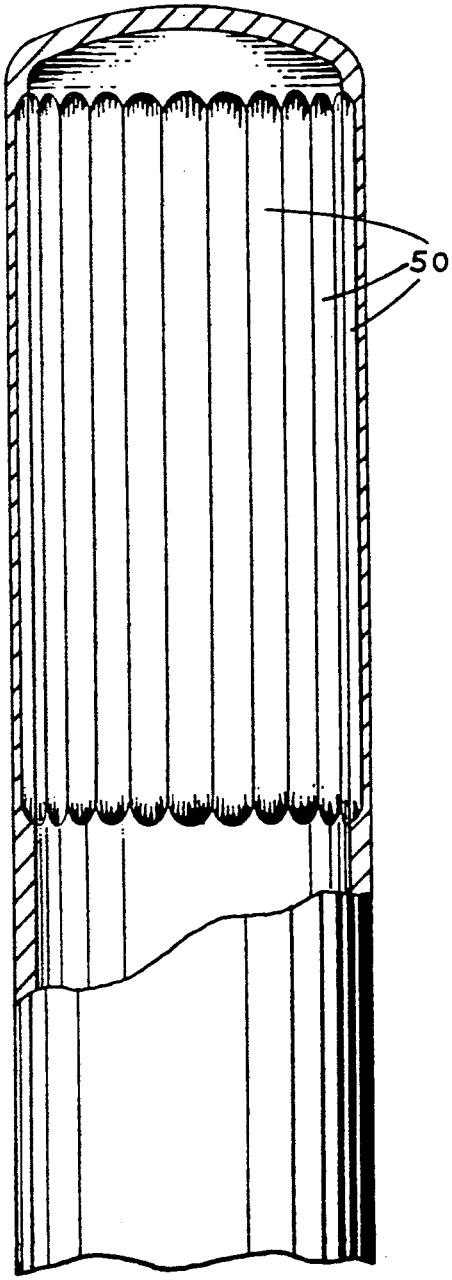
FIG. 12 is a fragmentary view of a bat head in accordance with another embodiment.

FIG. 12 shows an embodiment where the grooves 50 are longitudinal.

Figure 13:
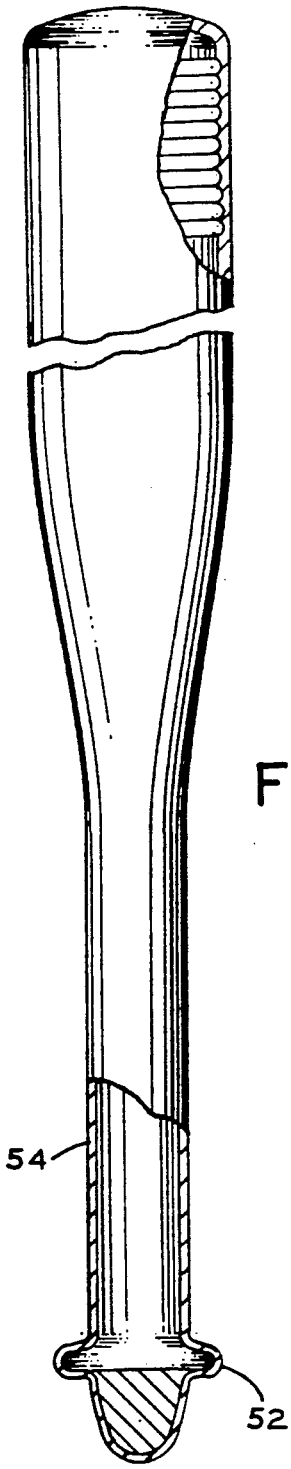
FIG. 13 shows another embodiment in which the bat and roll-over flange are one piece.

FIG. 13 shows an embodiment where the roll-over flange 52 is integral with the bat body 54.

We claim:

1. A ball bat comprising a tubular body having a head end; a tapered handle end; walls formed of aluminum alloy of a given thickness; a center of gravity; an acorn-shaped knob on said handle end, having a hollow extension projecting away from said handle end; and weighting means disposed in said hollow extension for shifting the center of gravity toward said handle end; said walls of said head end having internal reinforcing circular grooves formed therein.

2. A ball bat according to claim 1, including reinforcing means disposed in said head end of the bat for reinforcing said head end, said reinforcing means including a plurality of foam discs tightly fitting in said head end.

3. A ball bat according to claim 1, wherein said weighting means include lead.

4. A ball bat according to claim 2, wherein said means for reinforcing said head end include a core of structural foam in said head end, wherein said core of structural foam is divided into discs and wherein said discs are disposed perpendicular to the axis of said bat.

5. A ball bat according to claim 4 wherein said discs are stacked.

6. A ball bat according to claim 1, including weld means for attaching said acorn-shaped knob to said handle.

7. A ball bat according to claim 1 wherein said acorn-shaped knob includes a circular disc section projecting radially away from said tubular body.

8. A ball bat according to claim 7, wherein said circular disk section is made of solid metal.

9. A ball bat according to claim 8, wherein said circular disk section is threadedly attached to said handle end.

10. A ball bat according to claim 7, wherein said disk section is hollow and filled with lead or other weighting materials.

11. A ball bat according to claim 1, wherein said weighting means have a weight such that the center of gravity is located a distance of up to 75% of the length of said tubular body from said acorn-shaped knob.

12. A ball bat according to claim 1, including a weighted friction lining attached externally to said handle end that can extend a maximum of 18" from the knob.

* * * * *